US008894065B2

(12) United States Patent
Takayama

(10) Patent No.: US 8,894,065 B2
(45) Date of Patent: Nov. 25, 2014

(54) PRINTING APPARATUS AND METHOD FOR CONVEYING SHEET

(75) Inventor: Yuji Takayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/571,790

(22) Filed: Aug. 10, 2012

(65) Prior Publication Data

US 2013/0043639 A1 Feb. 21, 2013

(30) Foreign Application Priority Data

Aug. 19, 2011 (JP) ..... 2011-179781

(51) Int. Cl.

| | |
|---|---|
| ***B65H 29/66*** | (2006.01) |
| ***B41J 13/00*** | (2006.01) |
| ***B65H 29/12*** | (2006.01) |
| ***B65H 7/20*** | (2006.01) |
| ***B65H 29/14*** | (2006.01) |

(52) U.S. Cl.

CPC ..... *B41J 13/0009* (2013.01); *B65H 2601/521* (2013.01); *B65H 2511/514* (2013.01); *B65H 2513/51* (2013.01); *B65H 2511/22* (2013.01); *B65H 29/125* (2013.01); *B65H 2801/06* (2013.01); *B65H 7/20* (2013.01); *B65H 2511/20* (2013.01); *B65H 29/14* (2013.01); *B65H 2513/10* (2013.01); *B65H 2511/414* (2013.01)

USPC ..... 271/202; 271/3.17; 271/270

(58) Field of Classification Search

CPC ..... B65H 2513/10; B65H 2513/108; B65H 2513/21; B65H 2601/111

USPC ..... 271/3.14, 202, 203, 270

See application file for complete search history.

(56) References Cited

U.S. PATENT DOCUMENTS

| | | | | |
|---|---|---|---|---|
| 5,253,860 | A * | 10/1993 | Hirose et al. | 271/176 |
| 5,724,626 | A * | 3/1998 | Todoki | 396/612 |
| 6,179,495 | B1 * | 1/2001 | Sugata et al. | 396/612 |
| 6,378,864 | B1 * | 4/2002 | Iesaka | 271/270 |
| 7,410,164 | B2 * | 8/2008 | Koide et al. | 271/213 |

(Continued)

FOREIGN PATENT DOCUMENTS

| | | | |
|---|---|---|---|
| CN | 1246653 | A | 3/2000 |
| CN | 1866135 | A | 11/2006 |
| DE | 19643554 | A1 | 4/1997 |
| JP | 2008-273636 | | 11/2008 |

OTHER PUBLICATIONS

Chinese Office Action issued in counterpart Chinese Application No. 201210294769.X, dated Jul. 2, 2014.

*Primary Examiner* — Jeremy R Severson

(74) *Attorney, Agent, or Firm* — Fitzpatrick, Cella, Harper & Scinto

(57) ABSTRACT

The present invention provide a printing apparatus and a method for conveying a sheet wherein generation of noise is minimized using a simple configuration, wherein, during sheet discharging, a sheet is discharged at a speed suitable for the sheet discharging, and wherein the sheet is aligned at a sheet discharging position. The printing apparatus controls conveyance of sheets as follows. A first sheet and a second sheet fed subsequently to the first sheet are conveyed at a relatively low conveying speed until an upstream trailing end of the first sheet is placed at a sheet discharging standby position. Then, the first sheet is discharged to the sheet discharging position, and the first sheet and the second sheet are conveyed at a relatively low conveying speed until a downstream leading end of the second sheet is placed at a sheet feeding control position.

15 Claims, 9 Drawing Sheets

(56) References Cited

U.S. PATENT DOCUMENTS

| | | | | |
|---|---|---|---|---|
| 7,577,396 | B2 * | 8/2009 | Kitano | 399/405 |
| 8,408,544 | B2 * | 4/2013 | Reinke et al. | 271/288 |
| 2002/0158399 | A1 * | 10/2002 | Heno et al. | 271/3.14 |
| 2006/0114280 | A1 | 6/2006 | Koide et al. | |
| 2006/0263129 | A1 * | 11/2006 | Won | 399/405 |
| 2007/0071461 | A1 * | 3/2007 | Kitano | 399/16 |
| 2009/0212481 | A1 | 8/2009 | Takayama | |
| 2011/0268484 | A1 * | 11/2011 | Aoi | 399/397 |

* cited by examiner

PRINTING APPARATUS AND METHOD FOR CONVEYING SHEET

BACKGROUND OF THE INVENTION

1. Field of the Invention

The present invention relates to a printing apparatus and a method for conveying a sheet wherein a printed sheet is discharged after being aligned with a predetermined sheet discharging position.

2. Description of the Related Art

Printing apparatuses such as printers include a sheet discharging mechanism for discharging a sheet completely printed by a printing section after aligning the sheet with a predetermined sheet discharging position outside the apparatus. The sheet discharging mechanism in such a printing apparatus is configured such that a sheet discharging roller that is rotated by a driving source is compressed against a sheet and then rotated to exert a conveying force on the sheet, which is thus discharged to the exterior of the apparatus and stacked in a stacker.

In a series of operations from feeding of a sheet through printing by a printer or the like to sheet discharging, the volume of noise from the printing apparatus tends to increase consistently with the speed at which the sheet is conveyed. Thus, to reduce the volume of the noise from the printing apparatus, the sheet conveying speed needs to be decreased. Hence, some printing apparatuses are configured to provide a silent setting so that when a user selects the silent setting, the sheet conveying speed is reduced to lower the volume of the noise from the printing apparatus.

However, when a sheet is discharged from the sheet discharging roller and the sheet conveying speed is reduced, the force of the sheet discharging roller pushing the sheet out into the stacker with already discharged sheets stacked is decreased. Thus, even when the sheet discharging roller pushes the sheet out, the frictional force between the discharged sheet and the stacker or the sheets stacked in the stacker prevents the discharged sheet from reaching a regular position where the sheet is to be stacked. Consequently, the discharged paper may fail to be properly aligned with the stacker. Hence, a printing apparatus has been proposed which properly aligns the sheet discharged from the sheet discharging roller with the stacker by setting the sheet conveying speed to a given value or larger.

For example, in connection with a print medium conveying and discharging apparatus disclosed in Japanese Patent Laid-Open No. 2008-273636, a configuration of a sheet discharging mechanism has been proposed which changes a conveying speed between a conveying speed at which a sheet is conveyed by both a conveying roller and the sheet discharging roller and a conveying speed at which the sheet is conveyed only by the conveying roller. That is, when the sheet is conveyed by both the conveying roller and the sheet discharging roller, the conveying speed of the sheet discharging roller is set equal to the normal conveying speed of the conveying roller. Furthermore, when the sheet is conveyed only by the sheet discharging roller, the conveying speed of the sheet by discharging roller is set to a relatively high conveying speed suitable for alignment of a discharged sheet.

However, the print medium conveying and discharging apparatus in Japanese Patent Laid-Open No. 2008-273636 uses different driving sources for the sheet discharging roller and the conveying roller. Thus, the sheet discharging roller and the conveying roller are controlled so as to be rotated at different rotation speeds. In general, in view of the manufacturing cost of the printing apparatus, if the printing apparatus includes a plurality of roller pairs such as the conveying roller and the sheet discharging roller, a common driving source is preferably used to drive these roller pairs. Decreasing the number of driving sources in the printing apparatus in this manner enables an eventual reduction in the manufacturing cost of the printing apparatus. Hence, if the different driving sources are used for the sheet discharging roller and the conveying roller as in the printing apparatus disclosed in Japanese Patent Laid-Open No. 2008-273636, the manufacturing cost of the printing apparatus increases.

Furthermore, in the print medium conveying and discharging apparatus disclosed in Japanese Patent Laid-Open No. 2008-273636, the conveying speed at which a sheet is conveyed is set so as to be relatively high in a section where sheet is conveyed only by the sheet discharging roller and to be relatively low in a section where the sheet is conveyed by both the conveying roller and the sheet discharging roller. Thus, in the state where the sheet is conveyed only by the sheet discharging roller, the sheet is simply discharged at the higher speed. With the conveying speed thus set, even if an attempt is made to reduce the section where the sheet is conveyed at the relatively high conveying speed in order to inhibit possible noise, the setting of the length of the section is limited by the configuration of the apparatus. In particular, many printing apparatuses in which a printing area is provided between the conveying roller and the sheet discharging roller is adopted. In this case, a space for the printing area needs to be provided in the printing apparatus between the conveying roller and the sheet discharging roller. This limits the reduction in the distance between the conveying roller and the sheet discharging roller which is intended to decrease the section where the sheet is conveyed at the relatively high conveying speed. Consequently, even though a relatively long distance remains between the trailing end of a sheet and the sheet discharging position, the sheet is conveyed over a long section at the high conveying speed. Therefore, the state of noise at the high conveying speed may be continued for a long time.

SUMMARY OF THE INVENTION

Thus, in view of the above-described circumstances, an object of the present invention is to provide a printing apparatus and a method for conveying a sheet wherein generation of noise is minimized using a simple configuration, wherein, during sheet discharging, a sheet is discharged at a speed suitable for the sheet discharging, and wherein, the sheet is aligned with a sheet discharging position.

According to an aspect of the present invention, there is provided a printing apparatus comprising: a conveying unit for conveying a sheet through a conveying path; a printing unit located downstream of the conveying unit for printing onto the sheet; a sheet discharging unit located downstream of the printing unit for discharging the sheet from the conveying path to a sheet discharging position; a sheet feeding unit located upstream of the conveying unit for feeding the sheet to the conveying path; a driving unit for driving the conveying unit, the sheet discharging unit, and the sheet feeding unit; and a control unit for controlling the driving unit so that a first sheet and a second sheet fed subsequently to the first sheet are conveyed at a first conveying speed after a leading end of the first sheet is placed at a sheet feeding control position set upstream of a printing start position where the printing unit starts printing and before a trailing end of the first sheet is placed at a sheet discharging standby position where the first sheet can be discharged from the sheet discharging unit to the sheet discharging position at a predetermined sheet discharging speed, and then the first sheet and the second sheet are conveyed at a second conveying speed higher than the first conveying speed after the trailing end of the first sheet is positioned at the sheet discharging standby position and before the first sheet is discharged, and a leading end of the second sheet is placed at the sheet feeding control position.

According to an aspect of the present invention, there is provided a method for conveying a sheet in a printing apparatus including a conveying unit for conveying the sheet through a conveying path, a sheet discharging unit located downstream of the conveying unit for discharging the sheet from the conveying path to a sheet discharging position, a sheet feeding unit located upstream of the conveying unit for feeding the sheet to the conveying path, a printing unit located between the conveying unit and the sheet discharging unit for printing onto the sheet, and a driving unit for driving the conveying unit, the sheet discharging unit, and the sheet feeding unit, comprising: a first conveying step of conveying a first sheet and a second sheet fed subsequently to the first sheet at a first conveying speed after a leading end of the first sheet is placed at a sheet feeding control position set upstream of a printing start position where the printing unit starts printing and before a trailing end of the first sheet is placed at a sheet discharging standby position where the first sheet can be discharged from the sheet discharging unit to the sheet discharging position at a predetermined sheet discharging speed; and a second conveying step of conveying the first sheet and the second sheet at a second conveying speed higher than the first conveying speed after the trailing end of the first sheet is positioned at the sheet discharging standby position and before the first sheet is discharged and a leading end of the second sheet is placed at the sheet feeding control position. The present invention can provide a printing apparatus and a method for conveying a sheet wherein without the need to add special components, the volume of noise from the apparatus as a whole is reduced to enable silent operations and wherein, during sheet discharging, a sheet can be discharged with being accurately aligned at the sheet discharging position.

Further features of the present invention will become apparent from the following description of exemplary embodiments (with reference to the attached drawings).

DESCRIPTION OF THE EMBODIMENTS

Figure 1:
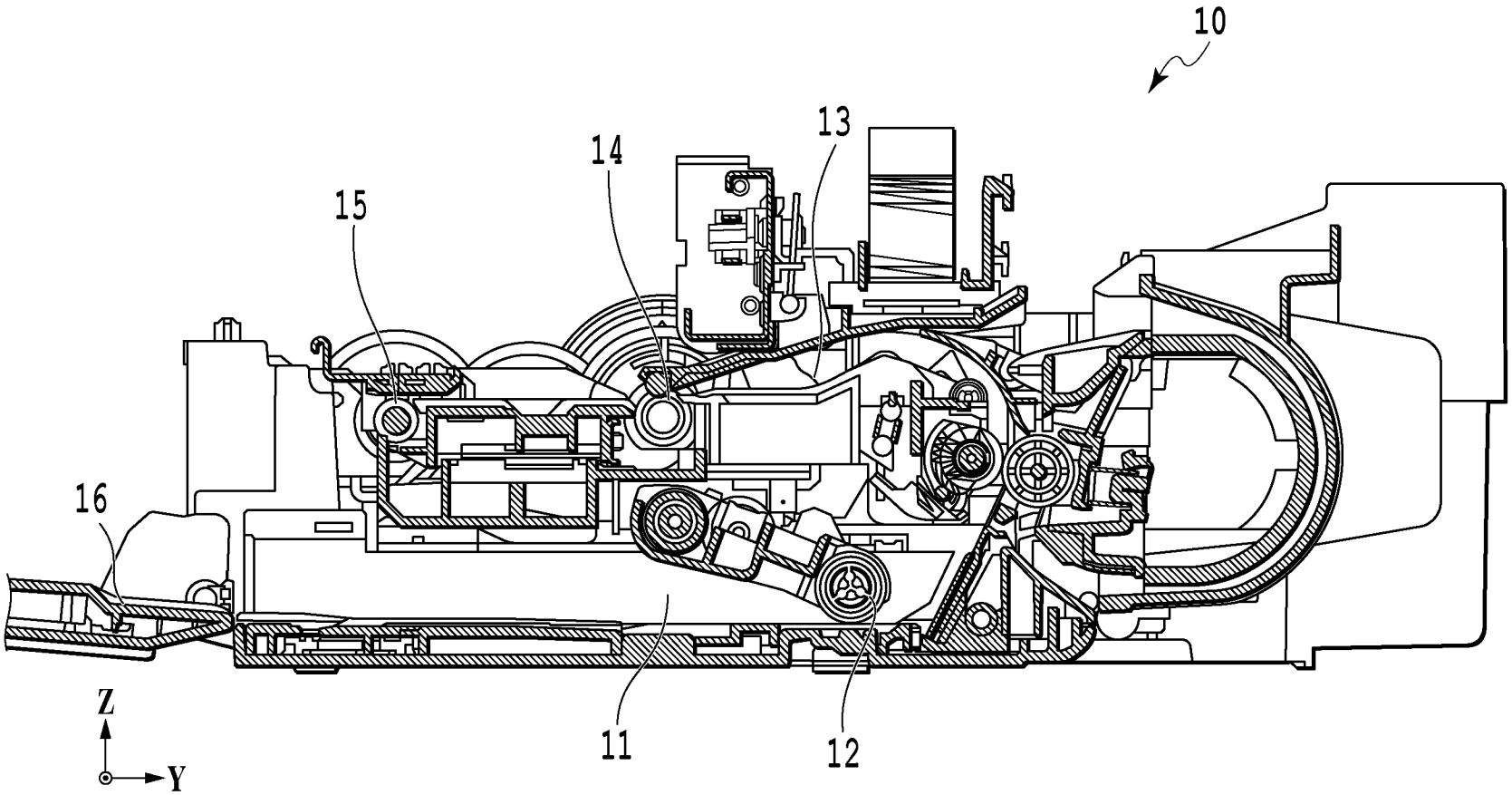
FIG. 1 is a cross-sectional view showing the internal configuration of a printing apparatus according to an embodiment of the present invention.

An embodiment of the present invention will be specifically described below with reference to the drawings. The same reference numerals denote the same or corresponding components throughout the drawings.

Figure 2:
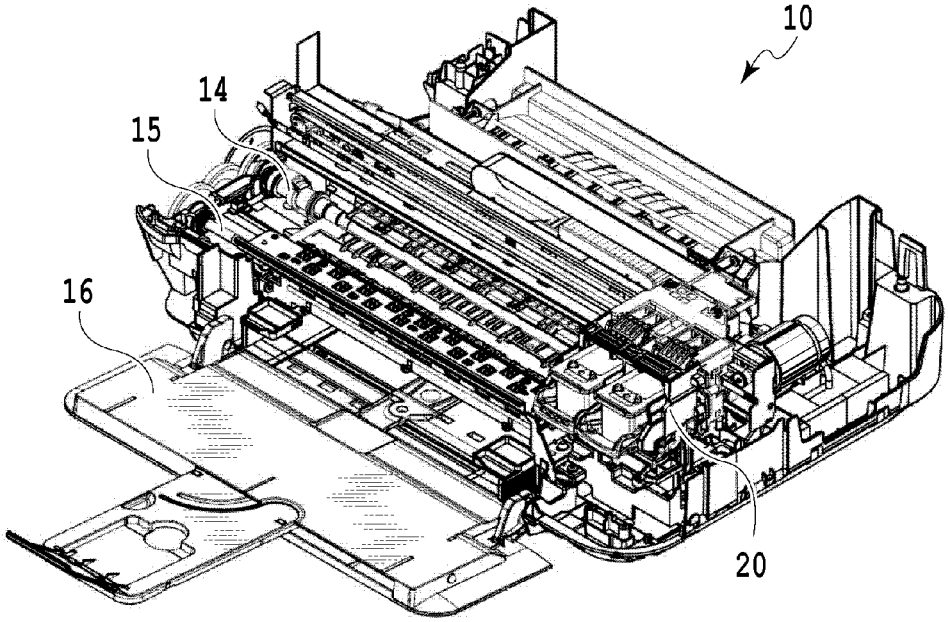
FIG. 2 is a perspective view showing the printing apparatus in FIG. 1.

FIG. 1 is a cross-sectional view schematically showing a printing apparatus according to the present invention. FIG. 2 is a perspective view schematically showing the printing apparatus. In FIG. 1, a printing apparatus 10 includes a sheet feeding roller 12 for feeding sheets (not shown in the drawing), a conveying roller 14, and a sheet discharging roller 15. The sheet feeding roller (sheet feeding unit) 12 is located in a conveying path L upstream of the conveying roller 14 to feed sheets to the conveying path L. The sheet feeding roller 12 feeds sheets to the conveying path L by rotating in condition that the sheet feeding roller 12 contacts to the sheet. In this case, the sheet feeding roller 12 feeds sheets by rotation of one roller. In the present embodiment, sheets are not fed by a pair of rollers. The conveying roller (conveying unit) 14 conveys the sheets along the conveying path L. The sheet discharging roller (sheet discharging unit) 15 is located in the conveying path L downstream of the conveying roller 14 to discharge the sheets from the conveying path into a sheet discharging tray (sheet discharging position) 16. The present invention is not limited to the above described embodiment. Each of the conveying roller 14, the sheet discharging roller 15, and the sheet feeding roller 12 may be a pair of rollers. A sheet stacking section 11 is configured such that a user of the printing apparatus 10 sets sheets in the sheet stacking section 11, and feeds the set sheets into the conveying path of the printing apparatus 10 using the sheet feeding roller 12. During a sheet feeding operation, a sheet detection sensor 13 (hereinafter referred to as a PE sensor) detects the leading end of a conveyed sheet, and the leading end detection information obtained is utilized to convey the sheet to a printing start position S1. The sheet conveyed by the sheet feeding roller 12 and having the leading end thereof detected by the PE sensor 13 reaches the conveying roller 14. The sheet is then conveyed to the printing start position S1 by the conveying roller 14. During a printing operation, the sheet is conveyed by both the conveying roller 14 and the sheet discharging roller 15. The PE sensor 13 detects the trailing end of the conveyed sheet during a printing operation or during sheet discharging. The trailing end detection information obtained is utilized to convey the sheet until discharging of the sheet is completed. When the printing operation is completed, the sheet is discharged into the sheet discharging tray 16 by the sheet discharging roller 15.

In FIG. 2, a print head unit 20 is arranged to be able to carry out printing between the conveying roller 14 and the sheet discharging roller 15. Thus, the printing apparatus 10 performs printing onto a sheet at a position corresponding to an area P in the conveying path L. The print head unit 20 performs a printing operation by ejecting ink to the sheet conveyed by the conveying roller 14 and the sheet discharging roller 15 while scanning the sheet in a direction orthogonal to a sheet conveying direction. The print head unit 20 includes a plurality of ejection ports formed therein and through which ink is ejected to the sheet during printing. According to the present embodiment, heating elements (electrothermal transductions) are arranged in channels inside the print head unit 20. A current is selectively conducted through the heating elements to allow the corresponding heating elements to generate thermal energy. Then, the ink in the corresponding channels is heated to generate bubbles due to film boiling, and associated bubbling energy allows the ink to be ejected through the ejection ports.

Figure 3:
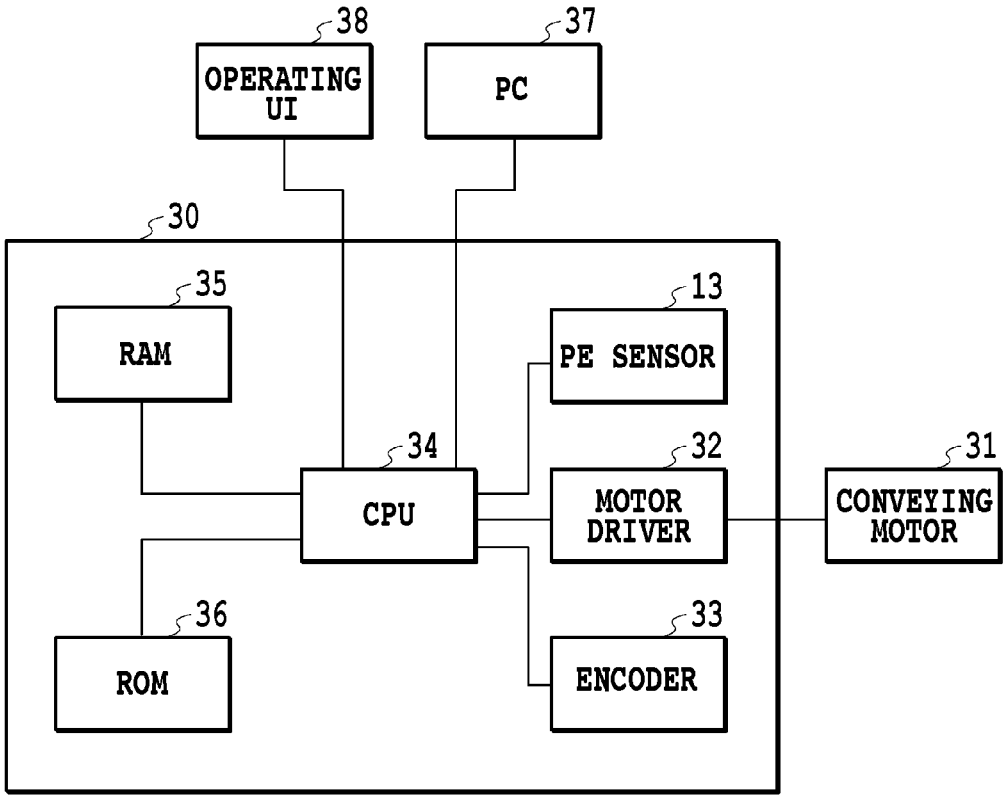
FIG. 3 is a block diagram showing a configuration of a control system for the printing apparatus in FIG. 1.

FIG. 3 is a block diagram showing a configuration of a control system for the printing apparatus 10 according to the present embodiment. A conveying motor 31 rotationally drives the sheet feeding roller 12, the conveying roller 14, and the sheet discharging roller 15. Thus, the conveying motor 31, serving as a common driving source, drives all of the sheet feeding roller 12, the conveying roller 14, and the sheet discharging roller 15. Furthermore, a CPU 34 is control unit arranged on a main board 30 to control the whole printing apparatus. A motor driver 32 controls the conveying motor 31 driving the sheet feeding roller 12, the conveying roller 14, and the sheet discharging roller 15. An encoder 33 detects rotation of the conveying roller 14. A RAM 35 temporarily stores constants for use in the control of the printing apparatus. A ROM 36 stores operational parameters for the printing apparatus 10 such as a control table for the conveying motor 31 and a state set by the user such as a silent mode. A PC 37 is provided outside the printing apparatus 10. An operating UI (User Interface) 38 is provided inside the printing apparatus 10. The PC 37 or the operating UI 38 transmits an instruction on a printing operation and an instruction to set the silent mode to the CPU 34.

In the present embodiment, the conveying motor 31 is connected to each of the sheet feeding roller 12, the conveying roller 14, and the sheet discharging roller 15 via transmission means so as to be able to drive each roller. Thus, the common driving source drives each of the sheet feeding roller 12, the conveying roller 14, and the sheet discharging roller 15, and each of the rollers is driven only by the conveying motor 31 serving as a single driving source. This reduces the number of driving sources required for the printing apparatus 10; the driving sources account for a relatively high percentage of the total manufacturing cost of the printing apparatus 10. As a result, the manufacturing cost of the printing apparatus 10 can be reduced. Furthermore, the present embodiment uses gears and the like as transmission means for transmitting the rotational driving force of the conveying motor 31 to each of the sheet feeding roller 12, the conveying roller 14, and the sheet discharging roller 15. Hence, the gears and the like serving as transmission means transmits the driving force of the conveying motor 31 to the conveying roller 14, the sheet discharging roller 15, and the sheet feeding roller 12. In the present embodiment, the driving unit refers to the conveying motor 31 serving as a driving source and the gears and the like serving as transmission means for transmitting the driving force of the conveying motor 31 to each roller.

Furthermore, in the present embodiment, the printing apparatus 10 can perform a continuous conveying operation of carrying out printing while conveying a plurality of sheets and continuously carrying out sheet feeding, conveyance, and sheet discharging. A continuous conveying operation performed by the printing apparatus 10 will be described.

When the PC 37 gives an instruction on a printing operation to the CPU 34, the CPU 34 first allows the motor driver 32 to rotate the conveying motor 31 in order to perform a sheet feeding operation. When the conveying motor 31 rotates, the rotational driving force of the conveying motor 31 is transmitted to each roller by the transmission means such as gears (not shown in the drawings). The sheet feeding roller 12, the conveying roller 14, and the sheet discharging roller 15 are then rotated. While the conveying roller 14 is being rotated, the CPU 34 carries out processing such as control of driving signals in accordance with a value read by the encoder 33. Consequently, the rotation speeds of the rollers are controlled. Furthermore, at the same time, the CPU 34 calculates a conveying distance.

The sheet feeding roller 12 rotates while being compressed against the sheets set in the sheet stacking section 11, to feed a sheet to the conveying path L in the printing apparatus 10. The fed sheet is conveyed by rotational driving performed by the conveying roller 14, and the leading end of the sheet, corresponding to the downstream side end in the conveying direction in the conveying path, reaches the PE sensor (sheet detecting unit) 13. When the leading end of the sheet reaches the PE sensor 13, the CPU 34 receives a detection signal from the PE sensor 13. Upon receiving the detection signal from the PE sensor 13, the CPU 34 determines that the sheet has reached the PE sensor 13 and uses the position of the PE sensor 13 as a start point for the conveyance, by the conveying roller 14, of the sheet to the printing start position S1. Since the distance is known by which the sheet needs to be conveyed from the position of the PE sensor 13 in order to reach the printing start position S1, the sheet can be accurately conveyed to the printing start position S1 by being conveyed by that distance from the position of the PE sensor 13. Then, at the printing start position S1, a printing operation can be started. As described above, the printing apparatus 10 according to the present embodiment includes the PE sensor 13 arranged on the conveying path and serving as sheet detecting unit capable of detecting the presence or absence of a sheet.

When the sheet is conveyed to the printing start position S1, a printing operation is performed by ejecting ink to the stopped sheet while allowing the print head unit 20 to carry out scanning. Thereafter, the conveyance of the sheet by the conveying roller 14 and the ejection of the ink by the print head unit 20 are repeated until the printing operation is completed.

When the operation of printing onto a predetermined print area of the sheet is finished, the sheet is then conveyed forward in the conveying direction by the conveying roller 14. When the leading end of the sheet in the conveying direction reaches the sheet discharging roller 15, the sheet is then conveyed cooperatively by both conveying roller 14 and the sheet discharging roller 15. When the conveying roller 14 and the sheet discharging roller 15 are further rotated to convey the sheet, the sheet passes between the rollers of the conveying roller 14 and is then sandwiched only between the rollers of the sheet discharging roller 15. When the sheet discharging roller 15 is further rotated to convey the sheet, the sheet is pushed out from the sheet discharging roller 15 and discharged into the sheet discharging tray 16 with already discharged sheets stacked therein.

Furthermore, the printing apparatus 10 according to the present embodiment can convey a plurality of sheets at the same time. That is, while a first sheet is being conveyed and printed, a second sheet can be fed and conveyed. Thus, when the trailing end of the first sheet that is to be printed first, that is, the conveyance-wise rear (upstream) end of the first sheet, passes through the sheet feeding roller 12, the sheet feeding roller 12 is compressed against the second sheet stacked in the sheet stacking section 11 to enable feeding of the second sheet to be started. In this manner, the printing apparatus 10 feeds the second sheet while the first sheet is being conveyed and printed, and thus conveys the two sheets at the same time.

According to the present embodiment, the sheet feeding roller 12 rotates at a lower peripheral velocity than the conveying roller 14 and the sheet discharging roller 15. Since each of the rollers is driven by the common driving source, each roller rotates at an equal angular velocity. However, the rollers rotate at different peripheral velocities depending on a difference in diameter among the rollers. Thus, the interval between the first sheet being conveyed by the conveying roller 14 and the sheet discharging roller 15 and the following second sheet increases in proportion to the amount by which the conveying roller 14 is rotated. Furthermore, the present embodiment sets timings for sheet feeding such that after the leading end of the second sheet is detected by the PE sensor 13 and before the sheet is conveyed to the printing start position S1, the first sheet is discharged into the sheet discharging tray 13. Additionally, the printing apparatus 10 is set such that after the operation of printing onto the first sheet is completed and before the first sheet is discharged, the operation of feeding the second sheet is performed to allow the plurality of sheets to be conveyed in the printing apparatus 10. Such an interval between the first sheet and the second sheet allows the printing apparatus 10 to perform a conveying operation and a printing operation onto the plurality of sheets.

If printing is carried out by the printing apparatus 10 as described above, noise may be generated from the printing apparatus 10 during printing. A cause of the noise from the printing apparatus 10 lies in a gear train and the like involved in a process of transmitting the driving by the conveying motor 31 to the rollers. Thus, the volume of the noise from the printing apparatus 10 tends to increase consistently with the rotation speed of the conveying motor 31. To reduce the volume of the noise, the printing apparatus 10 according to the present embodiment allows the user to input and set a silent mode via the PC 37 and the operating UI 38.

As described above, the printing apparatus 10 according to the present embodiment has the silent mode, which is different from a normal conveying mode in which a sheet is conveyed at the normal conveying speed. To reduce the volume of noise that may be generated during conveyance of the sheet, the sheet can be conveyed in the silent mode in which the sheet is conveyed at a speed lower than the normal conveying speed. According to the present embodiment, the CPU 34 transmits information indicating that the silent mode has been set to the ROM 36, where the information is stored. When the silent mode is set, the CPU 34 gives the motor driver 32 an instruction to rotate the conveying motor 31 at a reduced speed.

Figure 5:
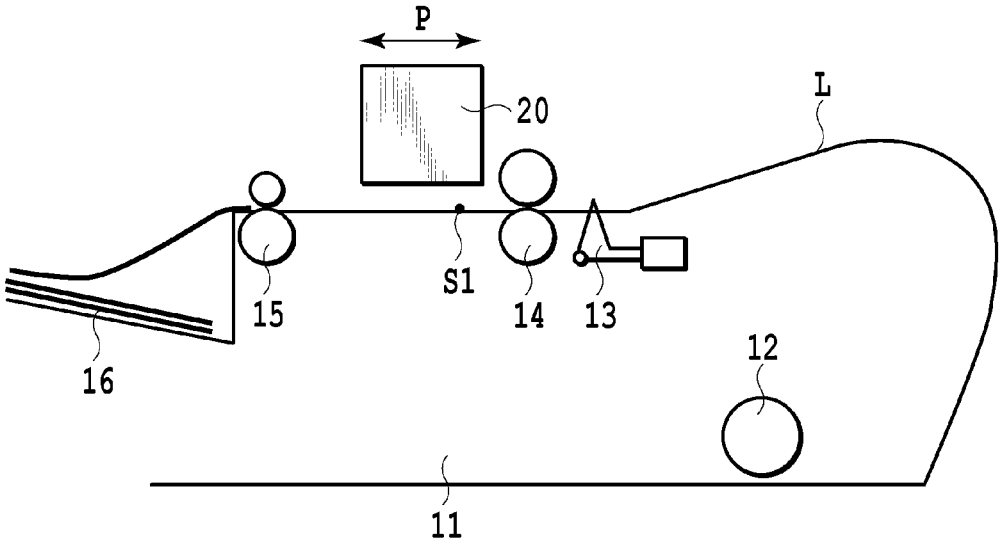
FIG. 5 is a schematic cross-sectional view of the printing apparatus in FIG. 1 in which a sheet has been discharged but has failed to reach a sheet discharging tray.

In the present embodiment, since each of the rollers is driven by the common driving source, if the silent mode is set, a sheet is conveyed at a speed lower than the normal conveying speed for all of the sheet feeding roller 12, the conveying roller 14, and the sheet discharging roller 15. However, if the number of rotations of the sheet discharging roller 15 is small when the sheet discharging roller 15 discharges the sheet into the sheet discharging tray 16, the speed may be insufficient during sheet discharging, preventing the sheet from being properly stacked at a predetermined position. As shown in FIG. 5, even though the trailing end of the sheet has been pushed out from the sheet discharging roller 15, a part of the sheet may fail to move into the sheet discharging tray 16, with the trailing end of the sheet caught at a position immediately after the sheet discharging roller 15.

To solve the problem that the discharged sheet fails to align properly with the predetermined position, the present embodiment performs control such that even with the silent mode set, when a sheet is discharged, each of the rollers is rotated at a speed suitable for sheet discharging.

Figure 4:
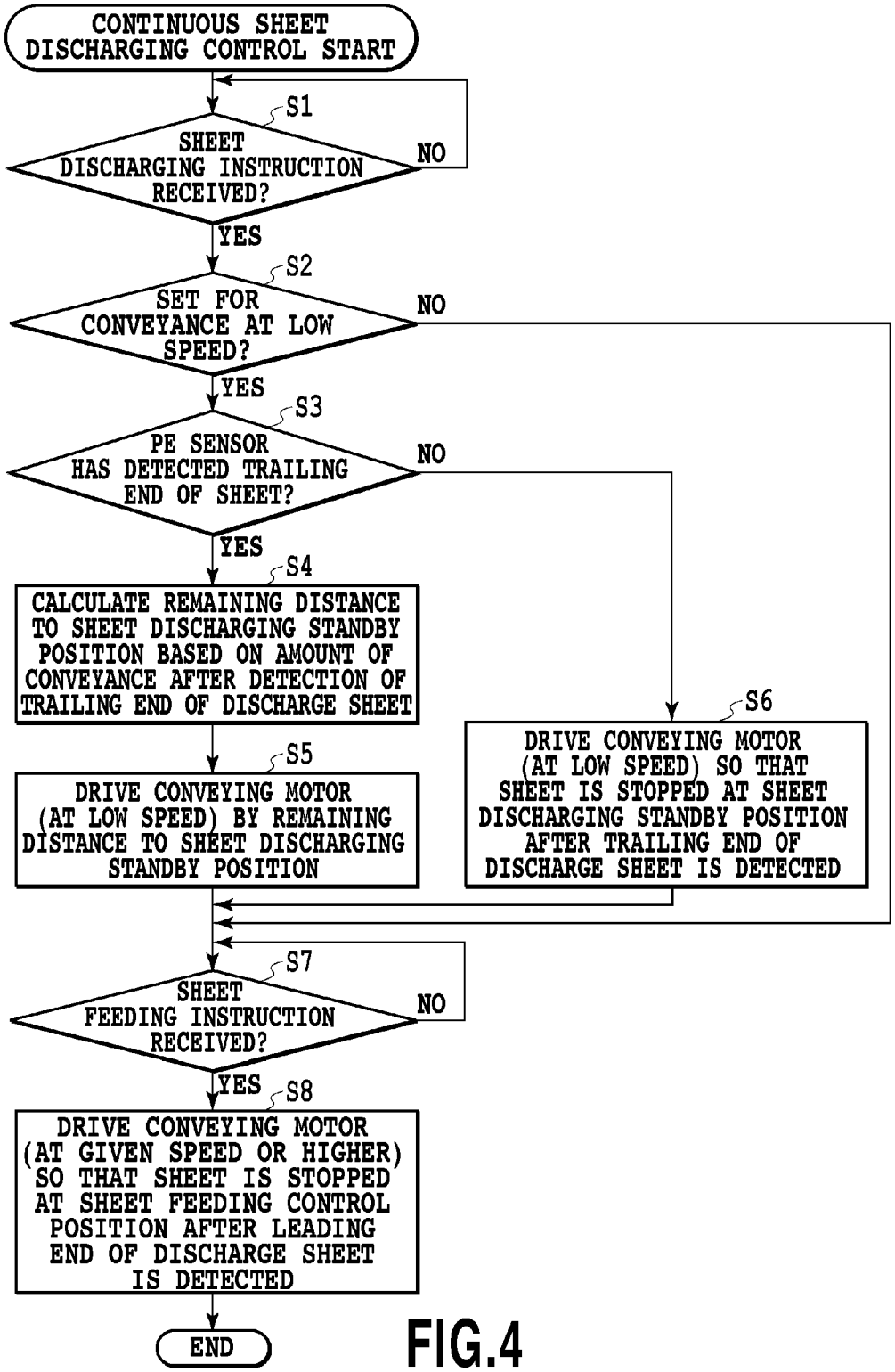
FIG. 4 is a flowchart showing a flow of control for sheet feeding, conveyance, and sheet discharging in the printing apparatus in FIG. 1.

With reference to a flowchart in FIG. 4, control will be described which is performed during the continuous conveying operation of the printing apparatus 10 configured as described above if the silent mode is set.

The printing apparatus 10 receives a sheet discharging instruction (S1), and determines whether the silent mode is set for sheet conveyance. At this time, if the conveying mode of the printing apparatus 10 is set to the silent mode to convey a sheet at a reduced speed (S2), the flow proceeds to S3. Then, a printing operation and sheet feeding, conveyance, and sheet discharging are carried out in the silent mode.

If the conveying mode of the printing apparatus 10 is not set to the silent mode, the sheet is conveyed with the sheet feeding roller 12, the conveying roller 14, and the sheet discharging roller 15 driven at the normal rotation speed.

Figure 6:
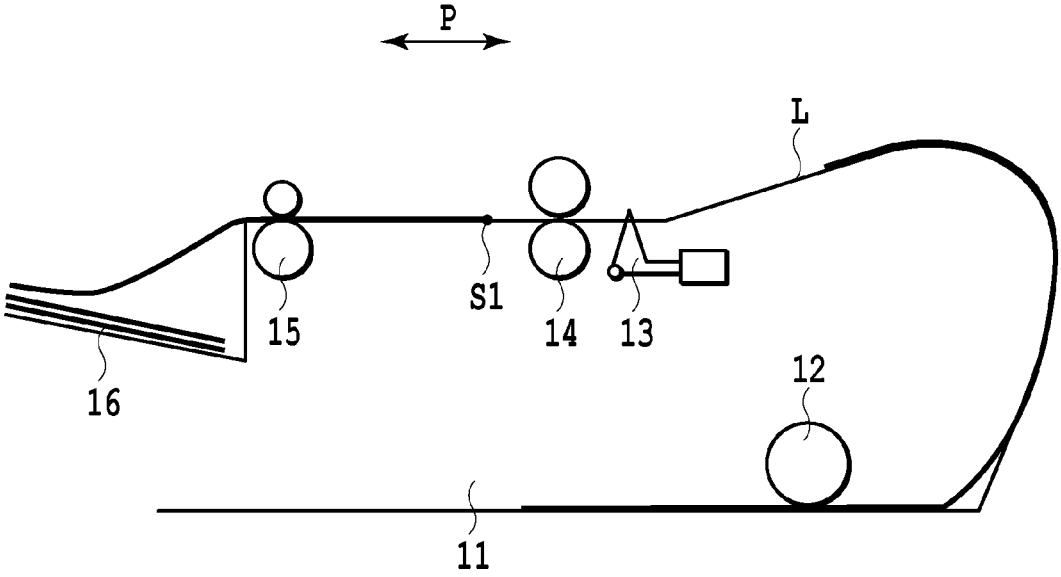
FIG. 6 is a schematic cross-sectional view of the printing apparatus in FIG. 1 in which the sheet detected by a PE sensor and then printed is being conveyed to a sheet discharging standby position.
Figure 8:
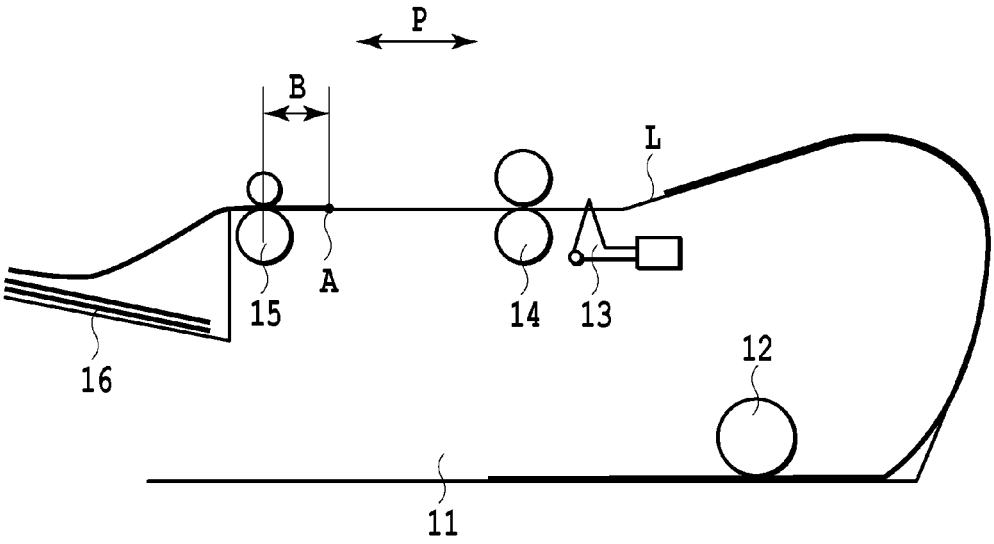
FIG. 8 is a schematic cross-sectional view of the printing apparatus in FIG. 1 in which a first sheet is conveyed to the sheet discharging standby position.

The case where the conveying mode of the printing apparatus 10 is set to the silent mode will be described below. In this case, as described below, a first sheet is conveyed at a relatively low speed (first conveying speed) during a section from a sheet feeding control position to a sheet discharging standby position A in the conveying path L. As shown in FIG. 6, if the trailing end of the first sheet (already printed sheet) is pre-detected by the PE sensor 13 (S3), the distance by which the sheet is moved until the trailing end of the sheet is placed at the sheet discharging standby position A is calculated based on information on the trailing end detected by the PE sensor 13 (S4). The sheet discharging standby position A corresponds to a conveying distance B required to discharge the conveyance-wise trailing end of the sheet to an upstream side of the sheet discharging roller 15 (FIG. 8). That is, the sheet discharging standby position A is spaced rearward from the sheet discharging roller 15 in the conveying direction by the sheet discharging distance required to discharge the sheet from the sheet discharging roller 15. If the sheet is discharged from the sheet discharging standby position A at a predetermined conveying speed for sheet discharging, when the sheet is pushed out from the sheet discharging roller 15, the sheet can at least move to a predetermined sheet discharging position inside the sheet discharging tray 16 into which the sheet is discharged.

The conveying distance B set on the conveying path L for discharging of the sheet from the sheet discharging roller 15 into the sheet discharging tray 16 may be determined according to the rotation speed of the sheet discharging roller 15 during sheet discharging. If the sheet discharging roller 15 rotates at a high speed during sheet discharging, a short conveying distance B may be used to allow the sheet to be pushed out by the sheet discharging roller 15 during sheet discharging. In contrast, if the sheet discharging roller 15 rotates at a low speed during sheet discharging, a correspondingly increased conveying distance B is required for sheet discharging. Therefore, the conveying distance B set to allow the sheet to be pushed out by the sheet discharging roller 15 during sheet discharging may be adjusted according to the rotation speed of the sheet discharging roller 15 during sheet discharging.

Thereafter, the conveying motor 31 is driven at a low speed so as to move the sheet by the remaining distance to the sheet discharging standby position A calculated in S4. The sheet is thus conveyed at the low speed until the trailing end of the sheet is placed at the sheet discharging standby position A (S5) (first conveying step). Thus, the present embodiment pre-calculates the distance by which the sheet is conveyed from the point where the conveyance-wise leading end of the sheet is detected by the PE sensor 13 to the point where the conveyance-wise trailing end of the sheet is placed at sheet discharging standby position A. The sheet is then conveyed by the calculated conveying distance. As a result, the sheet can be accurately conveyed to the sheet discharging standby position.

Figure 7:
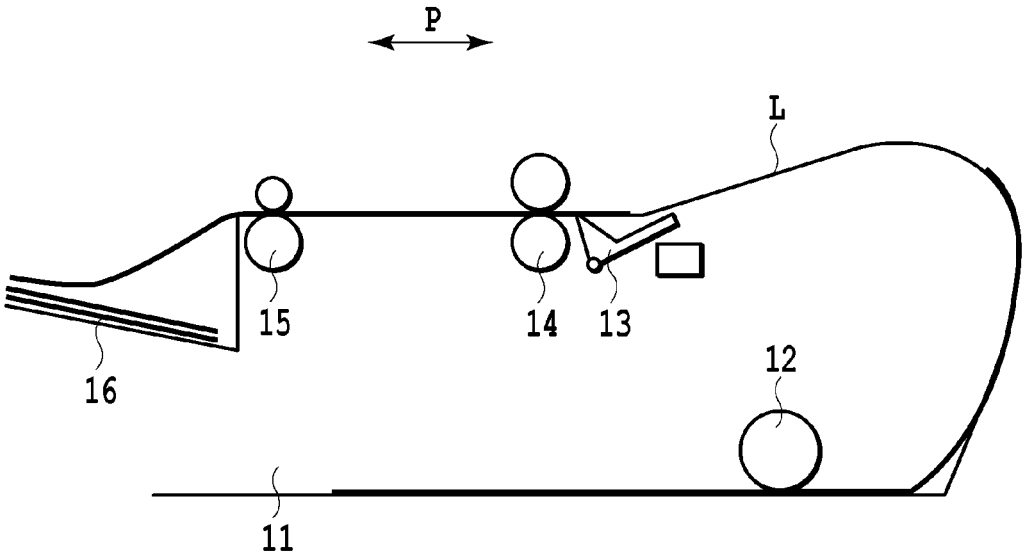
FIG. 7 is a schematic cross-sectional view of the printing apparatus in FIG. 1 in which the trailing end of the sheet has not been detected by the PE sensor yet.

As shown in FIG. 7, if the trailing end of the discharge sheet (the first sheet on which the printing operation is completed) is undetected by the PE sensor 13 (S3), the discharge sheet is conveyed until the conveyance-wise trailing end of the sheet is detected. When the PE sensor 13 detects the conveyance-wise trailing end of the sheet, the conveying motor 31 is driven at the low speed so as to convey the sheet using, as a start point, the position where the trailing end of the sheet has been detected, until the trailing end of the sheet is placed at the sheet discharging standby position A (S6). FIG. 8 shows that the trailing end of the first sheet is conveyed to the sheet discharging standby position A.

Figure 9:
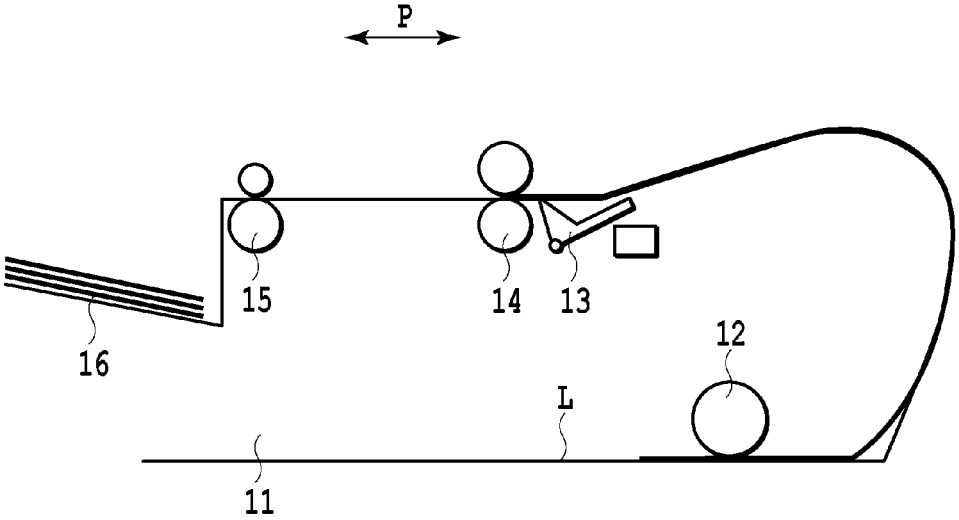
FIG. 9 is a schematic cross-sectional view of the printing apparatus in FIG. 1 in which the sheet is accurately discharged into a sheet discharging tray by a sheet discharging roller.

In a step shown in FIG. 8, the discharge sheet is about to be discharged into the sheet discharging tray 16 in the printing apparatus 10. Since the conveying speed has been set at the low speed so far, noise from the gears and the like has been suppressed. Furthermore, since the printing apparatus 10 can convey a plurality of sheets at the same time, the following second sheet has been conveyed such that the leading portion of the sheet is positioned immediately before the PE sensor 13. In the state shown in FIG. 8, the printing apparatus 10 receives a next sheet feeding instruction (S7) and then discharges the discharge sheet. Furthermore, the following second sheet is conveyed. That is, this feeding sheet (the sheet fed and conveyed subsequently to the discharge sheet; the second sheet) is conveyed using, as a start point, the position where the leading end of the feeding sheet is detected and at the conveying speed for sheet discharging in a part of the path along which the feeding sheet is conveyed to the printing start position S1. According to the present embodiment, the feeding sheet is conveyed at a relatively high conveying speed (second conveying speed) suitable for sheet discharging until the downstream leading end of the feeding sheet is placed at the sheet feeding control position in the path along which the feeding sheet is conveyed to the printing operation start position. That is, until the downstream leading end of the feeding sheet is placed at the sheet feeding control position, the first and second sheets are conveyed at the relatively high conveying speed (second conveying step). Here, the sheet feeding control position is set upstream of the printing start position S1, where the print head unit 20 starts printing. The feeding sheet is fed by the sheet feeding roller 12 and then conveyed to the sheet feeding control position at the relatively high conveying speed suitable for sheet discharging. Thus, when the sheet is discharged from the sheet discharging standby position A, the conveying motor 31 is driven at the predetermined speed or higher so as to achieve the conveying speed suitable for sheet discharging (S8). As described above, according to the present embodiment, even in the silent mode, when the sheet is discharged into the sheet discharging tray 16, the sheet is conveyed at the predetermined sheet discharging speed suitable for sheet discharging. Then, the sheet is discharged by being pushed out from the sheet discharging roller 15 over the conveying distance (sheet discharging distance) B that enables the sheet to be properly discharged from the sheet discharging roller 15 to the sheet discharging position in the sheet discharging tray 16. This allows the sheet to be reliably placed inside the sheet discharging tray 16 in an aligned manner by the sheet discharging roller 15 without being stopped on the conveying path after leaving the sheet discharging roller 15. Therefore, as shown in FIG. 9, the sheets can be properly aligned with one another inside the sheet discharging tray 16.

Furthermore, the printing apparatus 10 allows the section in which the sheet is conveyed at the speed suitable for sheet discharging to be set shorter regardless of the configuration of the printing apparatus 10. In the present embodiment, the sheet discharging distance by which the sheet can be properly discharged from the sheet discharging roller 15 to the sheet discharging position in the sheet discharging tray 16 is set as short as possible. When the sheet is conveyed at the speed suitable for sheet discharging, since the sheet conveying speed is set higher than the conveying speed corresponding to silence in the silent mode, relatively loud noise may be generated. However, since the section of the high speed for sheet discharging can be set shorter, the section of the relatively loud noise can be reduced, enabling generally silent conveyance. Thus, the present embodiment can provide a printing apparatus with a conveying mode with reduced noise.

While the second sheet following the first sheet to be discharged is being conveyed in the section from the position the second sheet is stacked before feeding to the printing start position where printing is carried out, the first sheet can be discharged at the conveying speed for sheet discharging. Consequently, the section of the conveyance at the relatively high speed for sheet discharging can be set between the sheet feeding position and printing position for the second sheet. Thus, the section of the conveyance at the relatively high speed for sheet discharging is not involved in the printing, allowing a change in conveying speed to be restrained from affecting the printing.

On the other hand, when the printing apparatus 10 receives a sheet discharging instruction (S1), if the conveyance is not set to the low speed (S2), the printing apparatus 10 is not set in the silent mode, and the sheet is conveyed in the normal conveying mode. Consequently, the sheet is conveyed at the given speed or higher. Thus, the sheet discharged during a sheet discharging step carried out concurrently with the subsequent sheet feeding operation (S7 and S8) is properly aligned with the other sheets. That is, if instead of the silent mode, the normal conveying mode is set for sheet conveyance, the sheet is conveyed at the speed suitable for sheet discharging all along the conveying path.

In connection with the section in which the sheet is conveyed at the speed suitable for sheet discharging, it is considered that the sheet may be conveyed at the speed suitable for sheet discharging while the sheet is sandwiched only between the rollers of the sheet discharging roller. However, if the sheet is conveyed at the speed suitable for sheet discharging throughout the duration when the sheet is sandwiched between the rollers of the sheet discharging roller, the conveying distance may be longer than necessary, resulting in an excessively long period when noise is generated. In such a case, the rate of the duration when noise is generated increases to prevent the printing apparatus 10 from being kept silent.

The above-described embodiment uses, as the printing apparatus 10, a serial scan printing apparatus that carries out printing by allowing the print head unit 20 to scan the sheet in the direction orthogonal to the sheet conveying direction. However, the present invention is not limited to the above-described embodiment and is applicable to a full line printing apparatus that uses a print head extending all over the print medium in its width direction.

The term "printing" as used herein is not limited to the formation of significant information such as characters and graphics; the term may be used regardless of the presence of meaning. The term "printing" also broadly refers to formation of images, patterns, or the like on print media or processing of print media regardless of whether not the result of the printing is visually perceivable by human beings.

Furthermore, examples of the "printing apparatus" include apparatuses with a print function such as a printer, a printer combined machine, a copier, and a facsimile machine, and manufacturing apparatuses configured to manufacture articles using an ink jet technique.

Additionally, the "sheet" as a print medium refers not only to paper, which is used for general printing apparatuses, but also broadly to a cloth, a plastic film, a metal plate, glass, ceramics, or leather, which can receive ink.

Moreover, the "ink" should be broadly interpreted as is the case with the definition of the "printing". The "ink" refers to a liquid which forms images, patterns, or the like or processes a print medium when applied to the print medium or which is used to process ink (for example, solidify or insolubilize a coloring material in ink applied to the print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179781, filed Aug. 19, 2011, which is hereby incorporated by reference herein in its entirety.

What is claimed is:

1. A printing apparatus comprising:

a conveying unit for conveying a sheet through a conveying path;

a printing unit located downstream of the conveying unit for printing onto the sheet;

a sheet discharging unit located downstream of the printing unit for discharging the sheet from the conveying path to a sheet discharging position;

a sheet feeding unit located upstream of the conveying unit for feeding the sheet to the conveying path;

a driving unit for driving the conveying unit, the sheet discharging unit, and the sheet feeding unit; and a control unit configured to control the driving unit so that a first sheet and a second sheet fed subsequently to the first sheet are conveyed at a first conveying speed after a leading end of the first sheet is placed at a sheet feeding control position set upstream of a printing start position where the printing unit starts printing and before a trailing end of the first sheet is placed at a sheet discharging standby position where the first sheet can be discharged from the sheet discharging unit to the sheet discharging position at a predetermined sheet discharging speed, and then the first sheet and the second sheet are conveyed at a second conveying speed higher than the first conveying speed after the trailing end of the first sheet is positioned at the sheet discharging standby position and before the first sheet is discharged, and a leading end of the second sheet is placed at the sheet feeding control position.

2. The printing apparatus according to claim 1, wherein each of the conveying unit and the sheet discharging unit is a pair of rollers.

3. The printing apparatus according to claim 1, wherein each of the conveying unit, the sheet discharging unit and the sheet feeding unit is a pair of rollers.

4. The printing apparatus according to claim 1, further comprising:

a sheet detecting unit located on the conveying path and configured to detect a presence or absence of a sheet; and a storage unit for storing information regarding a predetected distance from the sheet detecting unit to the sheet discharging standby position.

5. A method for conveying a sheet in a printing apparatus including a conveying unit for conveying the sheet through a conveying path, a sheet discharging unit located downstream of the conveying unit for discharging the sheet from the conveying path to a sheet discharging position, a sheet feeding unit located upstream of the conveying unit for feeding the sheet to the conveying path, a printing unit located between the conveying unit and the sheet discharging unit for printing onto the sheet, and a driving unit for driving the conveying unit, the sheet discharging unit, and the sheet feeding unit, comprising:

a first conveying step of conveying a first sheet and a second sheet fed subsequently to the first sheet at a first conveying speed after a leading end of the first sheet is placed at a sheet feeding control position set upstream of a printing start position where the printing unit starts printing and before a trailing end of the first sheet is placed at a sheet discharging standby position where the first sheet can be discharged from the sheet discharging unit to the sheet discharging position at a predetermined sheet discharging speed; and a second conveying step of conveying the first sheet and the second sheet at a second conveying speed higher than the first conveying speed after the trailing end of the first sheet is positioned at the sheet discharging standby position and before the first sheet is discharged and a leading end of the second sheet is placed at the sheet feeding control position.

6. A printing apparatus comprising:

a conveying unit for conveying a sheet through a conveying path;

a printing unit located downstream of the conveying unit for printing onto the sheet;

a sheet discharging unit located downstream of the printing unit for discharging the sheet from the conveying path to a sheet discharging position;

a sheet feeding unit located upstream of the conveying unit for feeding the sheet to the conveying path;

a driving unit for driving the conveying unit, the sheet discharging unit, and the sheet feeding unit; and a control unit configured to control the driving unit so that a first sheet and a second sheet fed subsequently to the first sheet are conveyed at a first conveying speed, and then the first sheet and the second sheet are conveyed at a second conveying speed higher than the first conveying speed after the trailing end of the first sheet is positioned at a sheet discharging standby position where the first sheet can be discharged from the sheet discharging unit.

7. A printing apparatus comprising:

a printing unit configured to perform a printing operation to print on a sheet at a printing position;

a conveying unit located upstream of the printing position in a sheet conveying direction and configured to convey the sheet;

a driving unit configured to drive the conveying unit;

a discharging unit located downstream of the printing position and configured to discharge the sheet, the discharging unit driven by the driving unit; and a control unit configured to control so that:

when a trailing end of a first sheet passes through the discharging unit, a second sheet subsequent to the first sheet is conveyed by the conveying unit, when the printing operation is performed by the printing unit, the driving unit is driven at a first driving speed, and when the trailing end of the first sheet passes through the discharging unit, the driving unit is driven at a second driving speed faster than the first driving speed.

8. The printing apparatus according to claim 7, wherein the control unit is configured to control so that the conveying unit conveys the second sheet by driving of the driving unit at the first driving speed to the printing position after driving of the driving unit at the second driving speed.

9. The printing apparatus according to claim 7, wherein the printing apparatus has a first mode in which the sheet is conveyed at a predetermined conveying speed, and a second mode in which the sheet is conveyed at a speed slower than the predetermined conveying speed, and in the second mode, the control unit is configured to control so that the driving unit is driven at the second driving speed, temporarily, in a predetermined period including a timing at which a trailing end of the first sheet is passed through the discharging unit.

10. The printing apparatus according to claim 9, wherein in the first mode, the driving unit does not increase the driving speed.

11. A printing apparatus comprising:

a printing unit configured to perform a printing operation to print on a sheet at a printing position;

a conveying unit located upstream of the printing position in a sheet conveying direction and configured to convey the sheet;

a driving unit configured to drive the conveying unit;

a discharging unit located downstream of the printing position and configured to discharge the sheet, the discharging unit driven by the driving unit;

a feeding unit configured to feed a sheet to the conveying unit, the feeding unit driven by the driving unit; and a control unit configured so that:

when a trailing end of a first sheet passes through the discharging unit, a second sheet subsequent to the first sheet is conveyed by the conveying unit, when the printing operation is performed by the printing unit, the driving unit is driven at a first driving speed, and when the trailing end of the first sheet passes through the discharging unit, the driving unit is driven at a second driving speed faster than the first driving speed.

12. The printing apparatus according to claim 11, wherein control unit is configured to control so that the conveying unit and the feeding unit convey the sheet by driving of the driving unit at the first driving speed after driving of the driving unit at the second driving speed, and the second sheet is conveyed to the printing position by the conveying unit.

13. The printing apparatus according to claim 11, wherein the printing apparatus has a first mode in which the sheet is conveyed at predetermined conveying speed, and a second mode in which the sheet is conveyed at a speed slower than the predetermined conveying speed, and in the second mode, the driving unit is driven at the second driving speed, temporarily, in a predetermined period including a timing at which a trailing end of the first sheet is passed through the discharging unit.

14. The printing apparatus according to claim 13, wherein in the first mode, the driving unit does not increase the driving speed.

15. A printing apparatus comprising:

a printing unit configured to perform a printing operation to print on a sheet at a printing position;

a supplying unit located upstream of the printing position in a sheet conveying direction and configured to supply a sheet to the printing position;

a driving unit configured to drive the supplying unit; and a discharging unit located downstream of the printing position, and configured to discharge the sheet, the discharging unit driven by the driving unit; and a control unit configured so that:

wherein when a trailing end of a first sheet passes through the discharging unit, a second sheet subsequent to the first sheet is supplied to the printing position by the supplying unit, wherein when the printing operation is performed by the printing unit, the driving unit is driven at a first driving speed, and wherein when the trailing end of the first sheet passes through the discharging unit, the driving unit is driven at a second driving speed faster than the first driving speed.

* * * * *